United States Patent [19]

Polliard et al.

[11] Patent Number: 5,033,188

[45] Date of Patent: Jul. 23, 1991

[54] METHOD OF MAKING AN ELECTRICAL HARNESS

[75] Inventors: Francis E. Polliard, Mechanicsburg; Kenneth F. Folk, Harrisburg, both of Pa.

[73] Assignee: AMP Incorporated, Harrisburg, Pa.

[21] Appl. No.: 477,185

[22] Filed: Feb. 5, 1990

Related U.S. Application Data

[63] Continuation of Ser. No. 262,383, Oct. 18, 1988, abandoned.

[51] Int. Cl.[5] ..... H01R 43/04

[52] U.S. Cl. ..... 29/861; 29/854; 29/863; 29/867

[58] Field of Search ..... 29/864, 854, 749, 33 M, 29/863, 867; 81/951

[56] References Cited

U.S. PATENT DOCUMENTS

| | | | |
|---|---|---|---|
| 2,954,599 | 10/1960 | Cootes et al. | 81/9.51 |
| 3,766,624 | 10/1973 | Grebe et al. . | |
| 3,872,584 | 3/1975 | Chick et al. | 29/867 |
| 4,554,725 | 11/1985 | Over et al. | 29/33 M |
| 4,631,822 | 12/1986 | Reinhertz | 29/863 |
| 4,653,160 | 3/1987 | Thorkildsen et al. | 29/749 |

FOREIGN PATENT DOCUMENTS

| | | | |
|---|---|---|---|
| 2260556 | 6/1973 | Fed. Rep. of Germany | 81/9.51 |
| 2039806 | 8/1980 | United Kingdom | 29/863 |

*Primary Examiner*—P. W. Echols
*Assistant Examiner*—I. Cuda
*Attorney, Agent, or Firm*—James M. Trygg

[57] ABSTRACT

An automated method of making an electrical harness of the type having a plurality of discrete wires includes one end of some or all of the wires terminating in a conductor. A wire of a desired type is automatically selected from a plurality of wires that are available for use. The wire is terminated with selected terminals and one end inserted into an appropriate cavity of a selected connector housing. Of the selected wires, at least one is of a different type than the others.

9 Claims, 7 Drawing Sheets

10
TERMINAL PRESSES
44
40
36
42
52
CUT & STRIP STATION
WIRE + SELECT
32
26
24
28
50
60
62
64
66
68
70
CONNECTOR LOADING STATION
31
90
42
COLLECTOR TRAY
84
X-Y ROBOT
80
LOADER
82
76
74
72
HOUSING TRAYS

METHOD OF MAKING AN ELECTRICAL HARNESS

This application is a continuation of application Ser. No. 262,383 filed Oct. 18, 1988, now abandoned.

The present invention relates to an automated method of making an electrical harness of the type having a plurality of discrete wires, one end of which, terminates in a connector.

BACKGROUND OF THE INVENTION

A commonly known type of harness making machine is shown in U.S. Pat. No. 4,628,600 which issued Dec. 16, 1986 to Gordon et al. and which is hereby incorporated by reference as if set forth verbatim herein. The machine of Gordon feeds a single wire, taken from a so-called "endless source," such is a reel of wire, to a cutting station for cutting into segments. Each segment receives a terminal on one end, which is crimped in place in the usual manner, and the other end is inserted into a cavity of a connector housing. When the desired number of discrete wire segments are prepared and inserted into the connector housing, the completed assembly is ejected and the process repeated for the desired number of times. Machines of this type are capable of feeding only a single wire and are not capable of selecting a wire of a particular type from a plurality of available wires and feeding that selected wire. U.S. Pat. No. 4,879,934, filed Oct. 8, 1987 and assigned to the assignee of the present invention, which is hereby incorporated by reference as if set forth verbatim herein, discloses such a selective wire feeding device. The feeding device accommodates six different wires, anyone of which may be selected and fed by a two belt feeding mechanism. The fed wire passes through a single wire passageway to a harness making machine for processing. When a wire segment of the desired length is severed, the stub remaining on the source side of the wire is retracted back into the single wire passageway so that one of the other wires may be subsequently selected and fed. Neither of these references teach an automated method of making an electrical harness wherein each wire of the harness is automatically selected from a plurality of available wires. The present invention discloses such an automated method.

SUMMARY OF THE INVENTION

The present invention relates to an automated method of making an electrical harness wherein a wire of a desired type is automatically selected from a plurality of wires of different types available for use. The wire is terminated with appropriate terminals and one end inserted into the appropriate cavity of a selected connector housing. The method includes selecting a wire from the plurality of wires and feeding the selected wire. The end of the wire is then terminated by attaching a terminal thereto, cutting the fed wire to form a segment of predetermined length, and terminating the cut end of the wire segment with a second terminal. The second terminal and wire end is moved to a connector loading zone and inserting into a selected cavity of a selecting connector housing.

DESCRIPTION OF THE PREFERRED EMBODIMENT

Figures 1, 1A:
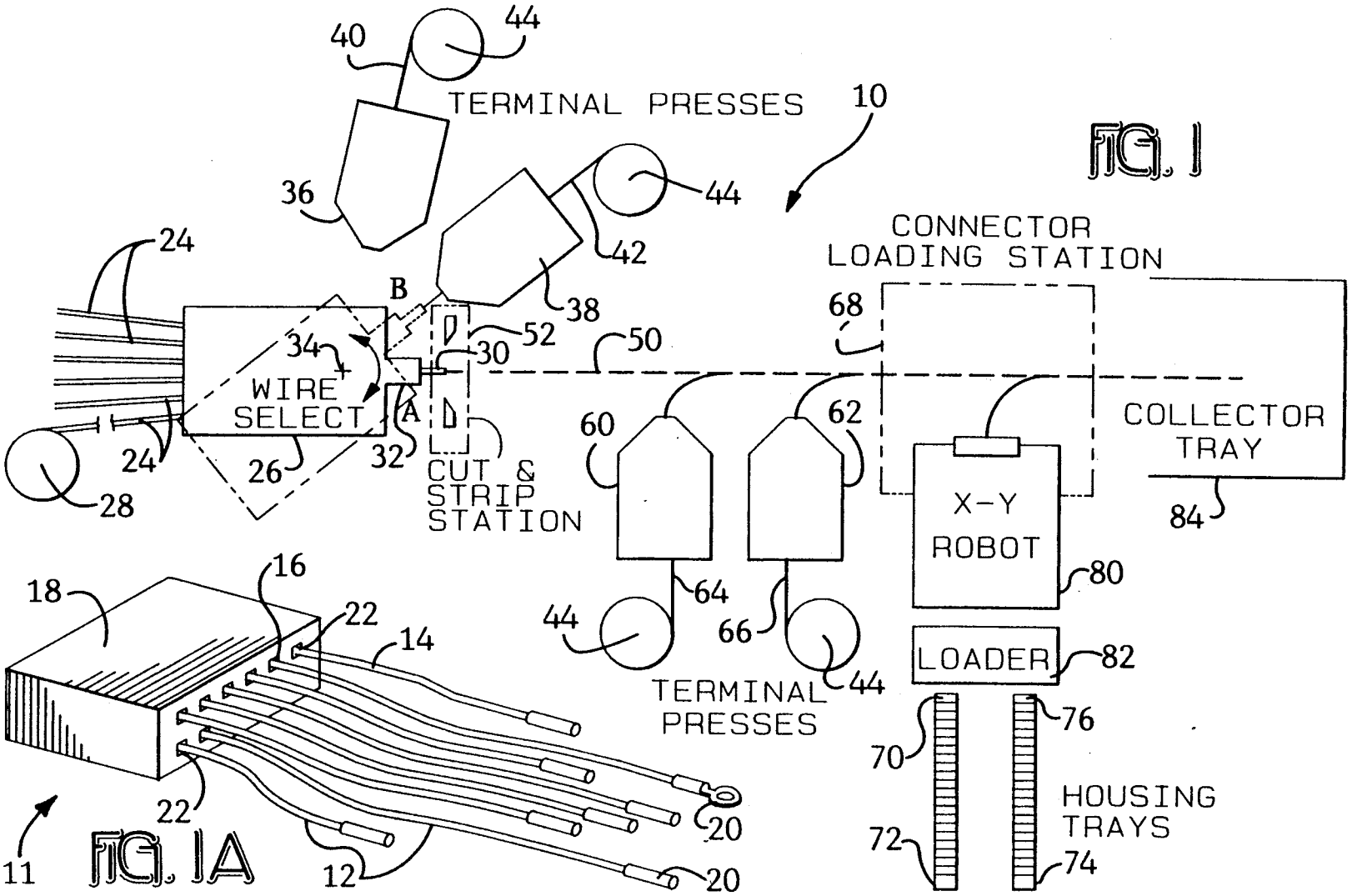
FIG. 1 is a schematic representation of the major functional components of a harness making machine which illustrates the teachings of the present invention wherein a selected wire has been terminated.
Figure 2:
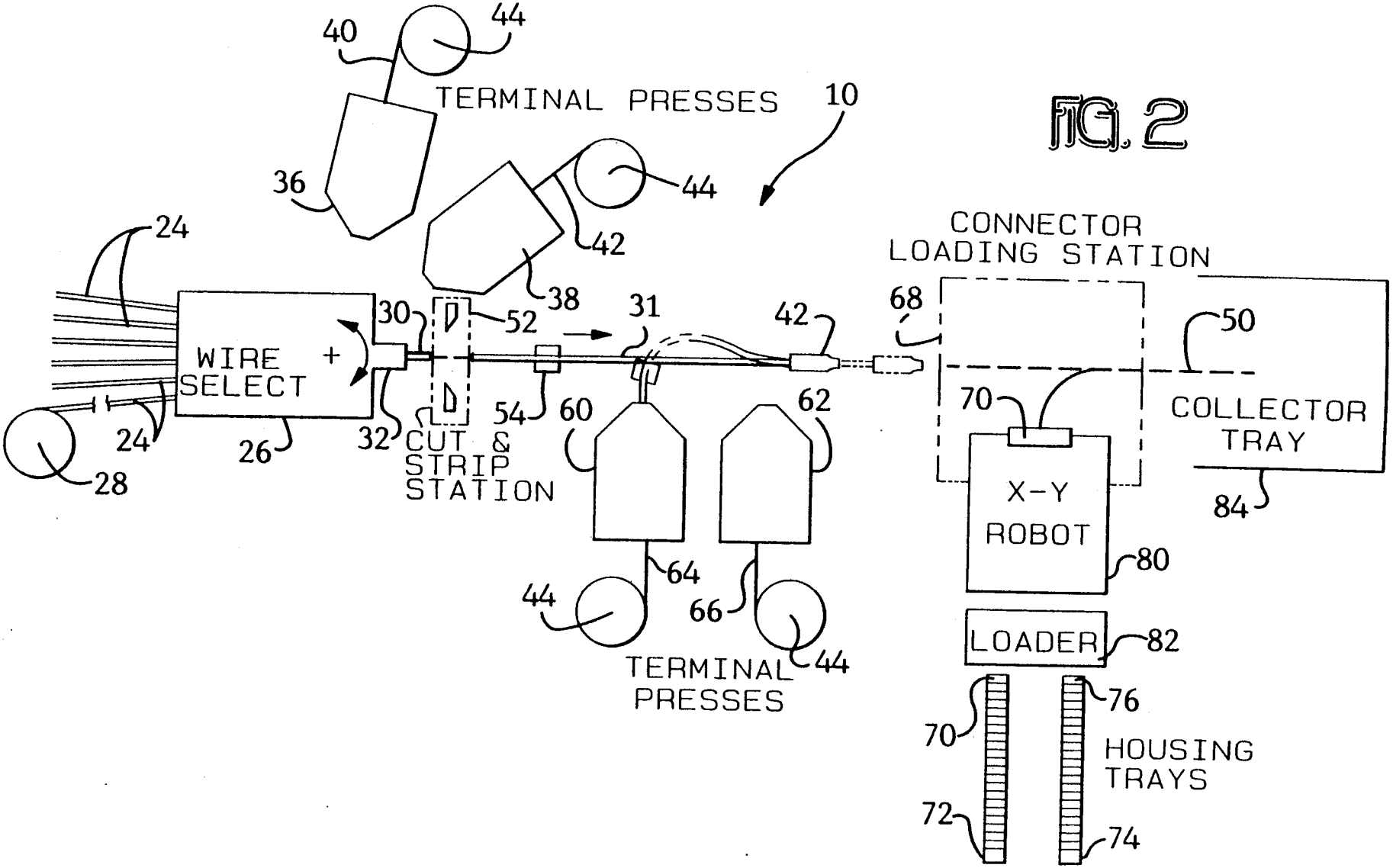
FIG. 2 is a schematic similar to that of FIG. 1 showing the cut wire segment terminated at both ends.
Figure 3:
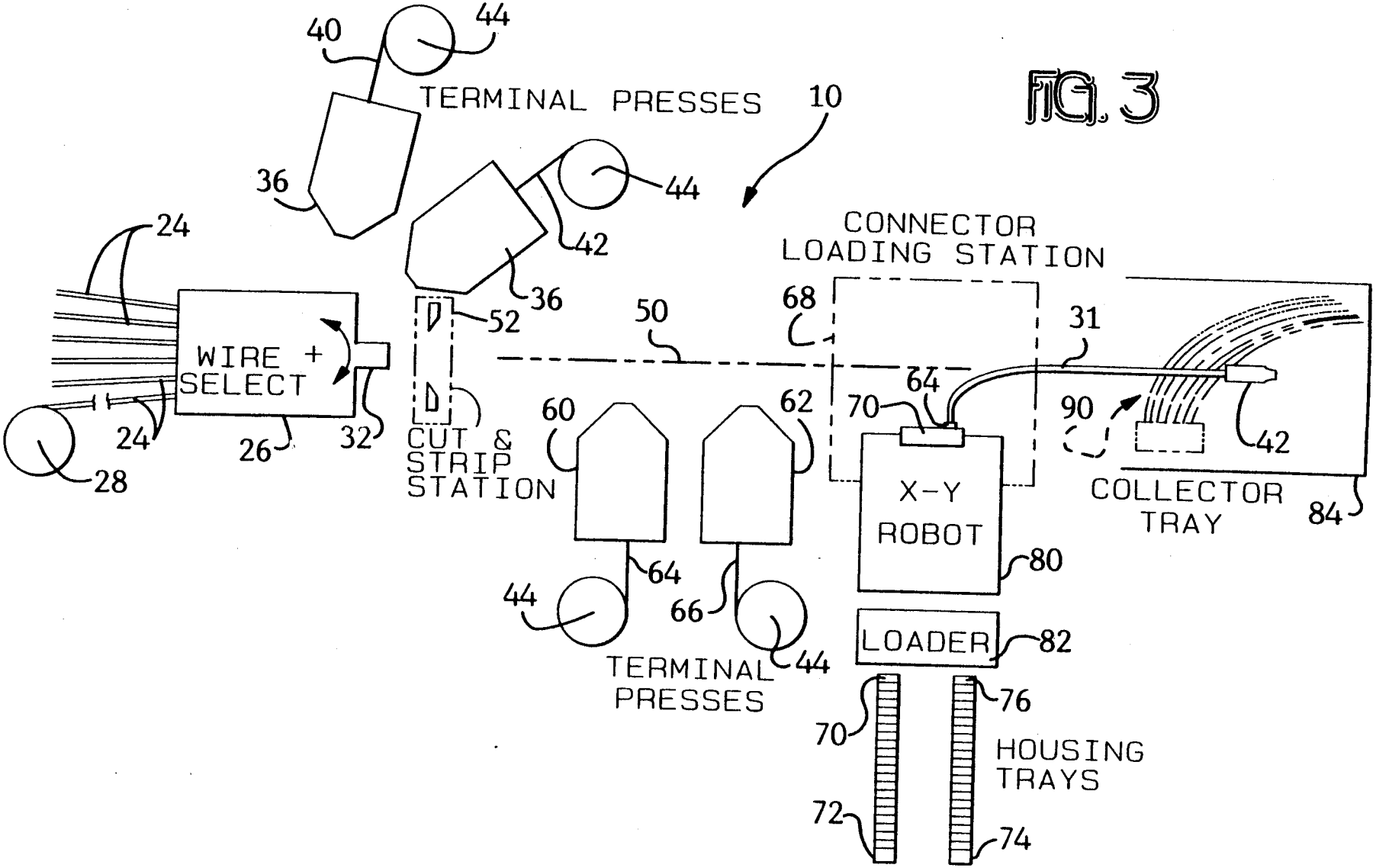
FIG. 3 is a schematic similar to that of FIG. 1 showing a connector housing having an end of the selected wire inserted therein.

The major functional elements of an electrical harness making machine 10 required in the making of a harness in accordance with the teachings of the present invention are schematically depicted in FIGS. 1, 2 and 3. An example of a harness 11, made by the present method is shown in FIG. 1A. A plurality of discrete wire segments 12 including a discrete wire segment 14 that is of a different type, such as different color, gage, or insulation, than the wires 12 are shown inserted into cavities 16 of a connector housing 18. Each discrete wire segment 12, 14 has a selected terminal 20 crimped onto a first end and a selected terminal 22 crimped onto a second end. The terminals 22 and second ends of the wire segments are inserted into appropriate cavities 16 as shown. Such electrical harnesses are well known in the art.

In the practice of the present invention, a plurality of discrete wires 24, some of which are of different type than others, are directed into a wire selection and feeding unit 26. Each of the wires 24 is pulled from a substantially endless source such as a barrel or reel 28. It will be understood that the wires 24 have been previously fed from the reels 28 into the wire selection unit 26 preparatory to harness making production. Initially, the first time that any of the plurality of wires is selected, its end is stripped of insulation as required by the terminals being used. Thereafter, when a wire segment is cut, the remaining wire is stripped and then retracted into the wire selection unit 26, thereby obviating the need to strip the wire upon subsequent selection.

To begin the operation, the first wire 30 to be processed is selected by the wire selection unit 26 and fed outwardly through a wire passageway 32 a specific distance. The wire selection unit 26 is then pivoted about a pivot point 34 until the end of the first wire 30 is presented to one of the terminal presses 36, 38. The wire selection unit 26 is shown in this pivoted position in phantom lines and indicated as B in FIG. 1. The terminal presses 36, 38 are arranged to crimp terminals 40 and 42 respectively which are dispensed from the reels 44 in strip form. The press that is selected corresponds to the terminal that is desired. The selected press, 38 in this example, crimps a terminal 42 onto the end of the wire 30. The wire select unit 26 is then pivoted about the point 34 in the opposite direction to return to its starting position shown in solid lines and indicated as A in FIG. 1.

The wire 30 is then feed along a wire path 50, shown in FIG. 1, to an extended position. Note that the wire 30 has passed through a wire cutting and stripping station 52. The wire 30 is extended along the wire path 50 for a predetermined distance. The cutting and stripping station 52 is then actuated thereby severing a wire segment 31 from the wire 30. During the severing process, the insulation is stripped from both the severed end of the segment 31 and the stub end of the wire 30, as shown in FIG. 2. The end of the wire segment 31 having the terminal 42 crimped thereto will be referred to as the first end while the newly severed end will be referred to as the second end. A clamp 54 retains the second end of the wire segment 31 in position on the wire path 50 during the cutting and stripping operations. The wire segment 31 is then fed along the wire path 50, from left to right as seen in FIG. 2, until the second end is presented to one of the terminal presses 60, 62. The terminal presses 60, 62 are similar to the terminal presses 36, 38 in that terminals in strip form, in this case terminals 64 and 66, are dispensed from the reels 44 for crimping on the second end of the wire segments. In the present example, the second end of the wire segment 31 is presented to the press 60 where a terminal 64 is crimped thereto.

The wire segment 31 is then moved further along the wire path 50, from left to right as viewed in FIG. 3, until the second end and the attached terminal 64 enter the connector loading station 68 and are presented to a selected cavity of a previously selected connector housing 70. The terminal 64 is then inserted into the selected cavity. A pair of housing trays 72 and 74 containing a supply of connector housings 70 and 76 respectively are suitably arranged so that a connector housing from either of the trays may be selected and loaded into an X-Y robot 80 by a loader 82. This is preferably done prior to the first wire segment 31 being moved into the connector loading station, or concurrently therewith.

To continue the operation, another wire 30 is selected by the wire selection unit 26 from the plurality of wires 24, and fed outwardly through the wire passageway 32. Note that this selected wire 30 may or may not be of a different type than that of the previously selected wire 30. The present wire 30 is presented to one of the presses 36, 38 for receiving a selected terminal 40, 42, extended to its desired length and cut into a wire segment. The cut end then receives a desired terminal from one of the presses 60, 62 which is then moved to the connector loading station and inserted into a selected cavity of the connector housing 70. This process is repeated until all of the desired wire segments 31 have been cut to length, properly terminated, and inserted into appropriate cavities in the selected connector housing. The connector housing 70 is then ejected from the X-Y robot 80 and the completed harness 90 placed in a collector tray 84. This process may be repeated to produce any desired number of similar electrical harnesses 90. It will be appreciated that any desired number of terminal presses 36, 38 and 60, 62 may be utilized to accommodate the number of different terminations required without departing from the spirit and scope of the present invention.

As is shown in FIGS. 1, 2 and 3, the movement of the wire segment 31 is along the wire path 50 which is in substantial alignment with the longitudinal axis of the segment 31. However, the harness making machine 10 of FIGS. 1, 2, and 3, may be arranged to move the wire segment 31 in a direction other than axially. See, for example, FIGS. 4, 5, and 6, which schematically depict a harness making machine 100 for making the harness 90 in accordance with the teachings of the present invention.

Figure 4:
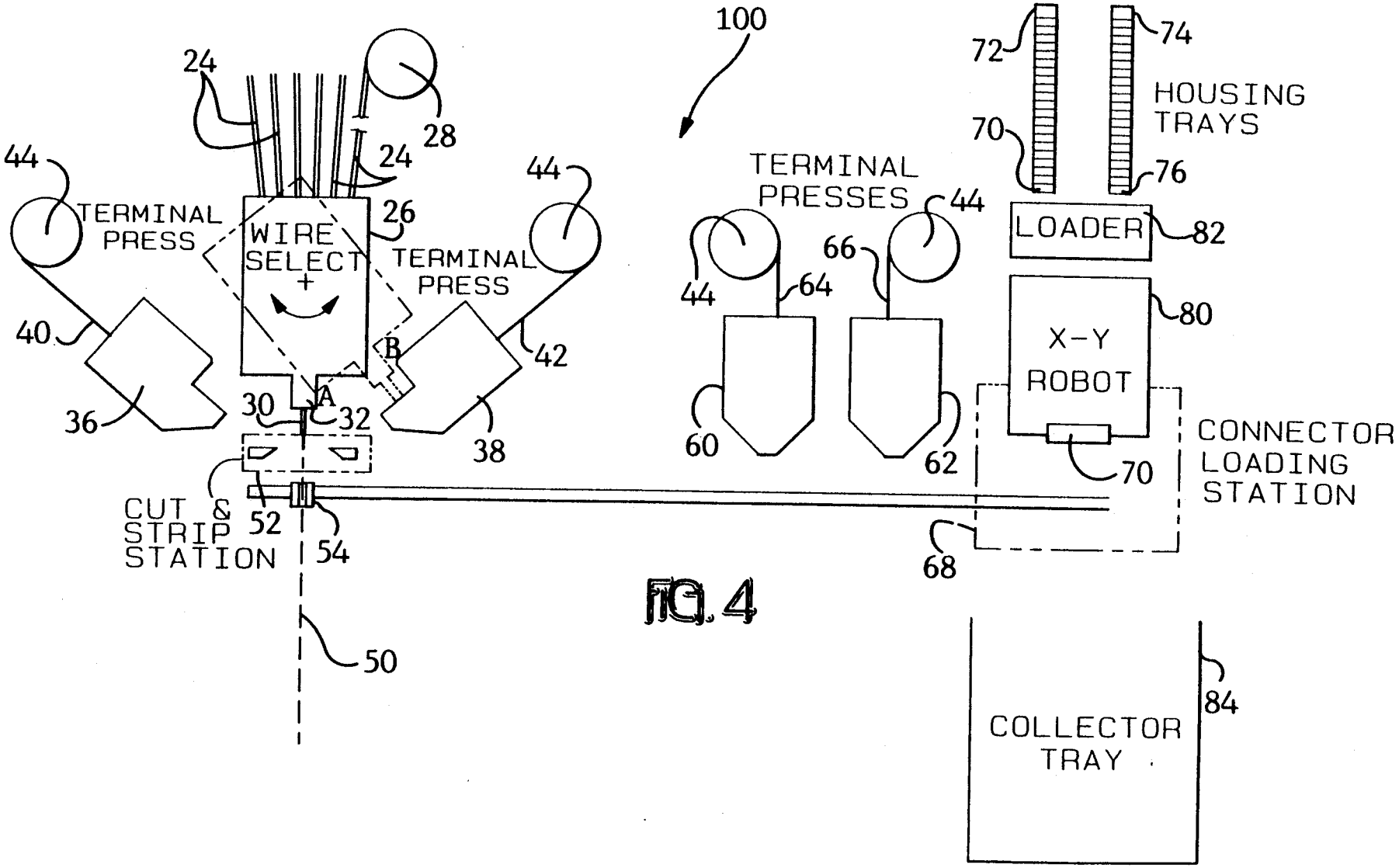
FIG. 4, 5 and 6 are schematic representations similar to those of FIG. 1, 2 and 3 respectively showing another embodiment of the present invention.
Figure 5:
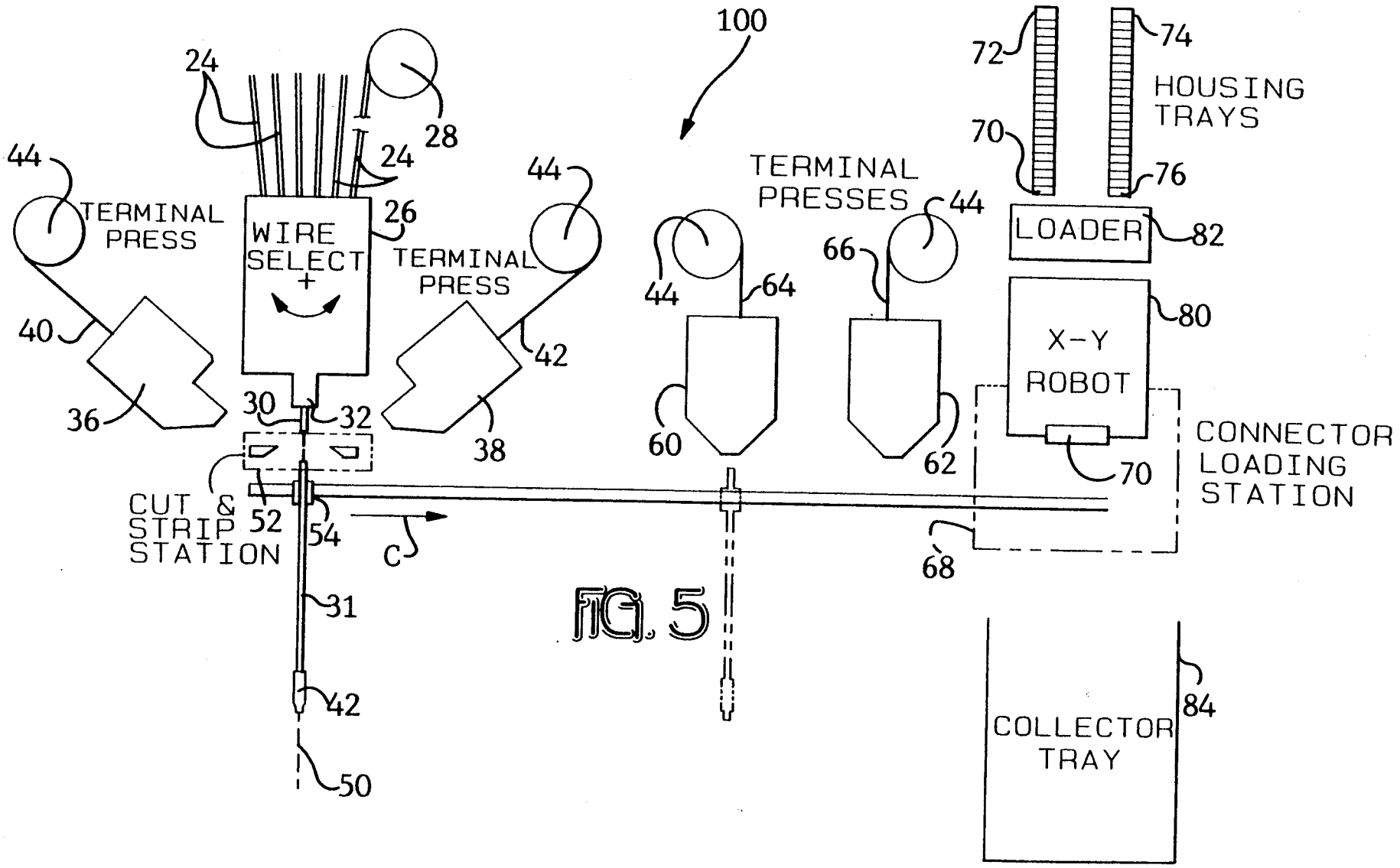
Figure 6:
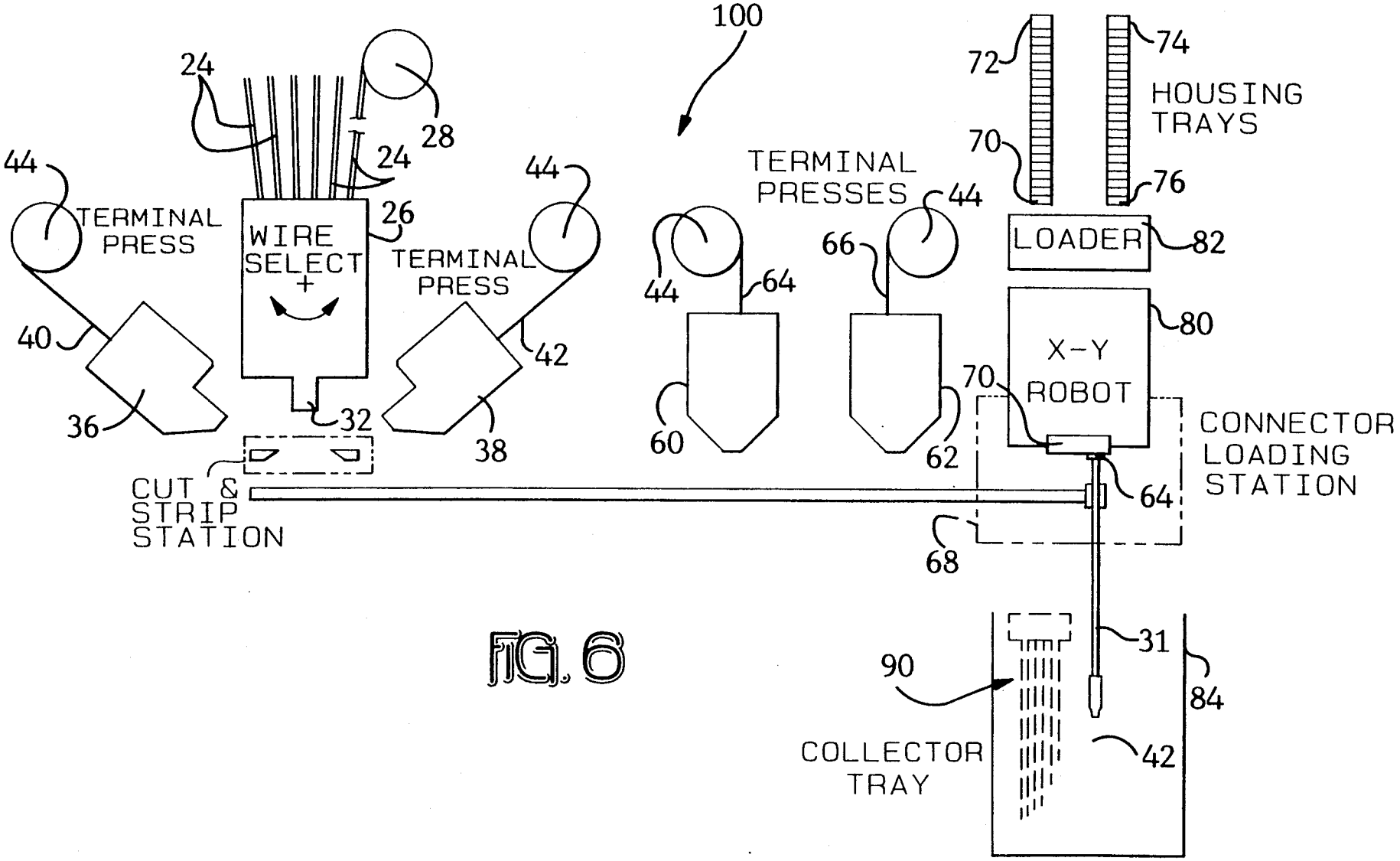

The machine elements of the machine 100 having the same identifying numbers as the machine elements of the machine 10, are substantially identical in form and operation. As is shown in FIGS. 4, 5, and 6, the machine 100 includes a wire selection and feeding unit 26 and an adjacent pair of terminal presses 36 and 38. A connector loading station 68, X-Y robot 80, loader 82, connector housing trays 72 and 74, and a collector tray 84 are located to the right side of the machine 100, as viewed in FIGS. 4, 5, and 6. A pair of terminal presses 60 and 62 are disposed between the unit 26 and the connector loading station 68. Note that in this arrangement the wire selection and feeding unit 26 is oriented so that the wire passageway 32 directs the selected wire 30 downwardly, as viewed in FIGS. 4, 5, and 6, along a wire path 50 that passes through a wire cutting and stripping station 52. As described above for the machine 10, the wire 30 is terminated with a selected terminal 42, then extended along the wire path 50, and cut and stripped to form a wire segment 31 of a desired length. The wire segment 31, being held by the gripper 54, is then moved laterally in a direction indicated by the arrow C, as shown in FIG. 5, to present the cut end, or second end, to the press 60 to crimp a terminal 64 thereon, the wire segment 31 is then again moved laterally to the connector loading station 68 where the terminal 64 is inserted into a selected cavity of the connector housing 70, see FIG. 6. The above steps are repeated until all of the desired wire segments 31 have been properly terminated and inserted into their respective cavities in the connector housing 70. The completed harness 90 is then ejected into the collector tray 84 as shown in FIG. 6. It is therefore seen that the method of the present invention can be practiced so that the wire segment 31 is moved in any of a variety of ways. What is important is that the wire 30 be automatically selected from a plurality of wires 24 which are usually of different type, such as different color, gage, or kind of insulation. While a particular harness may be composed of wire segments 31 of the same type wire, the method of the present invention permits the making of a harness having discrete wire segments of varying type and varying kinds of terminations on their ends. Further, the method of the present invention permits the automatic selection of the terminals and of the connector housing desired.

The mechanism utilized to practice the teachings of the present invention are known in the art, but, heretofore have not been brought together to form a harness making machine that is capable of performing the present method. The general arrangement of the machine may be in accordance with that disclosed in the above referenced U.S. Pat. No. 4,628,600 which discloses the functions, feeding, cutting and stripping, and terminating discrete wire segments. The mechanisms described therein or any suitable similar mechanisms known in the industry may be used to perform such functions. The above referenced U.S. patent application Ser. No. 107,147 discloses a wire selecting and feeding unit which may be utilized for the wire selection and feeding functions of the present invention. The '147 U.S. patent application discloses a device for selectively feeding any of a plurality of wires arranged in pairs, each pair having a first wire and a second wire. Each wire pair has a feeding unit associated therewith comprising a driver belt and two idler belts. The idler belts are movable between a feeding position and a non-feeding position. A specific wire is fed by moving its associated feeding belt to its feeding position and actuating the driven belt so that the wire is fed by the two belts. A wire guide is provided and has convergent passageways which extend to a wire outlet. After a wire segment has been cut, the wire stub can be retracted by reversing the direction of the driven belt. A reading of the '147 U.S. patent application will provide a more detailed explanation of the construction and operation of the wire selecting a not feeding unit.

Connector housing loader devices for pick-up of a connector housing from a tray or other dispenser of such housings and transfer and placement of the connector housing to an X-Y robotic holder including the X-Y robot are commonly known in the industry. See, for example, U.S. Pat. No. 4,650,391 which issued Mar. 17, 1987 to Adlon et al. and U.S. Pat. No. 4,611,846 which issued Sep. 16, 1986 to Feiber et al. Both Adlon and Feiber disclose devices which pick-up a connector from a tray and place it on a work piece. For an example of a typical X-Y robot device that can be suitably utilized in the practice of the present invention, see U.S. Pat. No. 3,042,171 which issued July 3, 1962 to Rose. All of these devices are well known in the art and therefore will not be described here. Apparatus for inserting the terminals 64 and second ends of the wire segments 31 into the cavities of the connector housing 70 is illustrated in U.S. patent application Ser. No. 154,745, filed Feb. 10, 1988 and is incorporated herein by reference and is assigned to the assignee of the present application. This insertion apparatus comprises two sets of closable jaws which are normally in mutual alignment and movable relative to each other. In operation, the first set of jaws is closed onto the wire adjacent the terminal and the second set is closed into surrounding and confining relationship with the terminal. The second set of jaws does not grip the terminal. The first set of jaws then moves toward the connector housing thereby inserting the terminal into the cavity using the second set of jaws as a guide. While this insertion apparatus can be utilized advantageously in the practice of the present invention, other suitable insertion apparatus may also be used.

Figure 7:
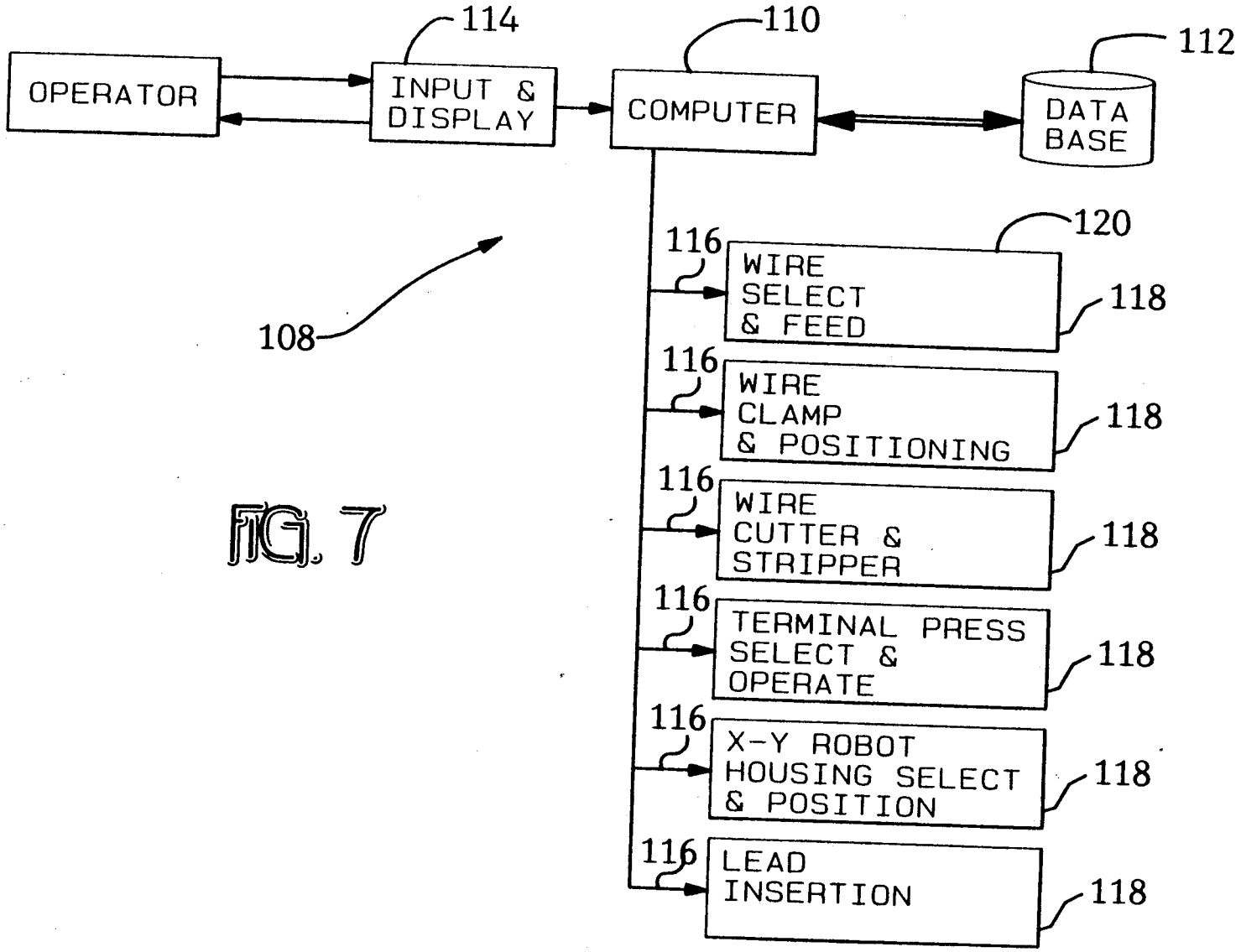
FIG. 7 is a block diagram showing the control function of the harness making machines of FIGS. 1 and 4.

A typical control system 108 for the harness making machine exemplified herein is depicted in the block diagram of FIG. 7. A computer 110, which in the present example is an IBM PC XT, includes a memory 112 for storage of harness making information. An input and display unit 114 is the primary interface between the operator and the control system 108. The computer 110 includes a series of output channels 116 which connect to and drive various instrumentalities 118 of the harness making machines 10 and 100. Since such control systems are well known in the computer art, no attempt will be made here to show this system in more detailed form. It will be understood that each of the instrumentalities 118, while shown in functional form, include the necessary driver circuitry and associated control devices to permit their operation and control. For example, the wire select and feed function 120 includes the wire selection and feeding mechanisms described above as well as the servo motors, control and power circuitry, and sense switches needed to effect positive control of the mechanisms by the computer. The operator, by manipulating the input and display unit 114, defines in the computer's memory, the parameters of the electrical harness that is desired. Also defined are the types of wires which are available to the wire selection and feeding unit 26, the types of terminals in each of the presses 36, 37, 60 and 62, and the types of connector housings in each of the trays 72 and 74. A control program within the computer's memory initiates operation of and maintains control of the various instrumentalities 118 in the making of the electrical harness by the method of the present invention.

It will be understood that the control system 108, set forth above, is by way of example of a typical control system that could be used. Various hardwire control systems that do not utilize a computer, and that are well known in the industry, can also be utilized in the practice of the present invention.

We claim:

1. In an automated method of making an electrical harness of the type comprising a plurality of discrete wires, each wire having a first end and a second end, the second end of some of the wires being connected to a terminal in a multi-contact electrical connector selected from a plurality of such connectors, wherein said plurality of discrete wires includes a wire of one type and a wire of another type, the steps of:

(a) selecting only a single wire from said plurality of wires, the proximate end of said selected wire being said first end and feeding said selected wire through a single wire passageway so that said first end projects therefrom; then (a1) determining the type of terminal desired and pivoting a portion of said selected wire until said first end is presented to a selected press having said desired terminal;

(b) terminating said first end by operating said press to attach a first discrete terminal thereto while said first end projects from said wire passageway; then (c) cutting a wire segment of predetermined length from said selected wire, the cut end of said wire segment being said second end;

(d) terminating said second end of said wire segment by attaching a second discrete terminal thereto;

(e) moving said second end of said wire segment to a connector loading zone and inserting said second end and attached terminal into a selected cavity in a selected connector housing; and (f) repeating steps (a) through (e) for a plurality of selected wires, wherein step (a) each wire is fed through the same said single wire passageway.

2. The method of claim 1 wherein step (a) includes determining the desired type of the wire to be selected and identifying which of said plurality of wires is that desired type.

3. The method of claim 2 wherein said repeating of steps (a) through (e) includes selecting a wire of a different type than that selected in one of the preceding steps (a).

4. The method of claim 3 wherein said inserting of step (e) comprises moving said selected connector housing until said selected cavity is in a particular position then inserting said second end and attached terminal thereinto.

5. The method of claim 4 wherein step (f) includes determining the desired type of connector housing to be selected and loading it into an X-Y robot.

6. The method of claim 5 wherein said repeating of step (f) is continued until at least two connector housings have been selected and each has said second end of at least one wire segment inserted therein.

7. The method of claim 6 wherein step (b) includes selecting a first press containing said first discrete terminal from a plurality of presses containing different terminals, and wherein step (d) includes selecting a second press containing said second discrete terminal from said plurality of presses.

8. The method of claim 7 wherein said moving said selected connector housing includes actuating said X-Y robot.

9. The method of claim 8 wherein step (c) includes stripping the cut end of said selected wire, then reverse-feeding said selected wire until said stripped cut end is retracted a predetermined distance.

* * * * *